US005242607A

United States Patent [19]

Yamamura et al.

[11] Patent Number: 5,242,607

[45] Date of Patent: Sep. 7, 1993

[54] CONCENTRATED SOFTENER

[75] Inventors: Masaaki Yamamura, Tochigi, Japan; Junichi Inokoshi, St. Paul, Minn.; Kazutaka Shiratsuchi; Toru Hayase, both of Tochigi, Japan

[73] Assignee: Kao Corporation, Tokyo, Japan

[21] Appl. No.: 767,880

[22] Filed: Sep. 30, 1991

[30] Foreign Application Priority Data

Oct. 5, 1990 [JP] Japan ..... 2-268070

[51] Int. Cl.[5] ..... D06M 10/08

[52] U.S. Cl. ..... 252/8.6; 252/8.8

[58] Field of Search ..... 252/8.8, 8.6

[56] References Cited

U.S. PATENT DOCUMENTS

| | | | |
|---|---|---|---|
| 4,514,444 | 4/1985 | Ives et al. . | |
| 4,678,590 | 7/1987 | Nakamura et al. | 252/8.8 |
| 4,828,722 | 5/1989 | Steltenkamp . | |
| 4,877,539 | 10/1989 | Ploog et al. | 252/8.8 |
| 4,885,102 | 12/1989 | Yamamura et al. . | |
| 4,937,008 | 6/1990 | Yamamura et al. . | |
| 5,066,414 | 11/1991 | Chang | 252/8.8 |
| 5,154,838 | 10/1992 | Yamamura et al. | 252/8.6 |

FOREIGN PATENT DOCUMENTS

| | | | |
|---|---|---|---|
| 158869 | 10/1985 | European Pat. Off. . | |
| 0199382 | 10/1986 | European Pat. Off. . | |
| 0299787 | 1/1989 | European Pat. Off. . | |
| 0335404 | 10/1989 | European Pat. Off. | 252/8.8 |
| 3904754 | 8/1989 | Fed. Rep. of Germany . | |
| 2601390 | 1/1988 | France . | |
| 2192909 | 1/1988 | United Kingdom . | |

*Primary Examiner*—Olik Chaudhuri
*Assistant Examiner*—C. Everhart
*Attorney, Agent, or Firm*—Birch, Stewart, Kolasch & Birch

[57] ABSTRACT

A softener composition comprises (a) 7 to 30 wt. % of a neutralization product with an inorganic or organic acid having not more than 6 carbon atoms of one selected from the group consisting of (a−1) an amine compound having 2 or 3 hydrocarbon groups each having 11 to 22 carbon atoms in its molecule and (a−2) an ion complex compound formed from 1 mole of a polyamide having a hydrocarbon group having 11 to 22 carbon atoms and 2 to 5 nitrogen atoms and 1 mole of an aliphatic acid having 12 to 22 carbon atoms and (b) 0.2 to 5 wt. % of one or more polyethers, each being an adduct of an alkylene oxide including ethylene oxide to a compound having 3 or more active hydrogens, which contains 50 wt. % or more of the polyoxyethylene units, having a molecular weight of 5,000 to 2,000,000. It is of the concentrated type and provides clothing with an improved softness and anti-static property.

8 Claims, No Drawings

CONCENTRATED SOFTENER

BACKGROUND OF THE INVENTION

1. Field of the Invention

The present invention relates to a softener, more particularly to a concentrated softener for clothes which can impart excellent softness and antistatic properties to various fibers and which causes little change in handleability with the lapse of time even when stored in a state exposed to the air.

2. Description of Related Art.

Clothes are liable to be stiffened by the washing-off of a fiber treatments or the deterioration of the fibers themselves during the repetition of wearing and washing to result in uncomfortable handling. Therefore, a softener which can impart softness and antistatic properties to fibers has recently been used frequently in many families.

Most of the current commerically available household softeners comprise a cationic surfactant having 1 to 2 long-chain alkyl groups, and in particular, di(hardened tallow alkyl)dimethylammonium salt as a main cationic surfactant component.

A softener base material comprising such a quaternary ammonium salt as a main component is difficultly soluble in water, so that the above softeners are generally prepared in the form of a 3 to 5% by weight aqueous dispersion or emulsion. As clothes to be treated with a softener have increased, a concentrated softener, for clothes which is constituted of a high-concentration aqueous dispersion, has been strongly desired in order to reduce distribution and/or packaging costs or to reduce the storage space in a shop, home or the like.

However, the above aqueous dispersion type softener is so viscous when its concentration is 5% by weight or above it causes various problems in handling.

Known processes for the preparation of such a higly-concentratted softener include:

1) a process which comprises adding a water-soluble cationic surfactant,
2) a process which comprises adding an adduct of a higher alcohol or an alkylphenol with ethylene oxide,
3) a process which comprises adding urea or ethylene glycol, and
4) a process which comprises adding a water-soluble salt.

When a softener has an increased viscosity, it gels and gets filmy on the surface, it can result in difficult pouring from a container, will clog at the outlet of a container, can be difficulty measured and will get difficulty dispersible.

In the prior arts it is known to add the compounds of processes (1) to (4) discussed, supra, to a softener base.

In the cases of (1) to (3), a sufficient concentration cannot be obtained. The viscosity of the resultant softner increases on storing and can provide no softening effect. As for (4), the viscosity initially decreases. After that, it is difficulty prevented from increasing. A large amount of a salt added thereto will cause phase separation of the dispersion.

Recently, a concentrated softener which comprises a quaternary ammonium salt and a specific polyether compound and which exhibits little change in the viscosity over time has been proposed (see Japanese Patent Laid-Open Nos. 26788/1989 and 19573/1990). However, when this softener is allowed to stand in a state in contact with, its handleability is remarkably deteriorated over timw owing to a dissolved state generated by the evaporation of water. Further, when it is stored in an uncapped bottle, it is thickened, gelled or filmed. Thus, no satisfactory concentrated softener for clothes has been found as of yet.

Under these circumstances, the present inventors have eagerly studied this matter to solve the above problem, thus accomplishing the present invention which relates to a concentrated softener for clothes.

SUMMARY OF THE INVENTION

Namely, the present invention provides a concentrated softener for clothes comprising as the active ingredient an effective softening amount of (a) 7 to 30% by weight of at least one neutralization product of one of the following amine compounds with an inorganic acid or an organic acid having not more than 6 carbon atoms:
  (a-1) primary or secondary amines each having 2 or 3 hydrocarbon groups wherein, with each of the hydrocarbon groups has 11 to 22 carbon; and
  (a-2) ion pairs each being a polyamine having 2 to 5 nitrogen atoms and one hydrocarbon group having 12 to 22 carbon atoms wherein the molar ratio of said polyamine to said hydrocarbon group is 1:1 and
(b) at least one polyether which is a polyoxyalkylene adduct of a compound having at least 3 active hydrogen atoms, with an alkylene oxide component comprising ethylene oxide as an essential component wherein the sum total of polyoxyethylene chain segments produced is at least 50% by weight of the weight of said polyether and wherein the average molecular weight is 5,000 to 2,000,000, and derivatives thereof.

In other words, the invention provides a softener composition comprising (a) 7 to 30 wt. % of a neutralization product with an inorganic or organic acid having not more than 6 carbon atoms of one or more selected from the group consisting of (a−1) an amine compound having 2 or 3 hydrocarbon groups each having 11 to 22 carbon atoms in its molecule and (a−2) an ion complex compound formed from 1 mole of a polyamine having a hydrocarbon group having 11 to 22 carbon atoms and 2 to 5 nitrogen atoms and 1 mole of an aliphatic aicid having 12 to 22 carbon atoms and (b) 0.2 to 5 wt. % of one or more polyethers, each being an adduct of an alkylene oxide including ethylene oxide to a compound having 3 or more active hydrogens, which contains 50 wt. % or more of the polyoxyethylene units, having a molecular weight of 5,000 to 2,000,000.

The softener composition comprises (a) a neutralization product formed from (a−1) and/or (a−2) and an organic or inorganic acid. It is preferable that (a−1) an amine compound and a polyamine to use for (a−2) include (A-1) to (A-10) described hereinbelow. A mixture of two or more of (A-1) to (A-10) may be used.

An ion complex formed between a cationic compound and an anionic compound is intended. 1 mole of a polyamine having two or more nitrogen atoms and 1 mole of an aliphatic acid will form an ion complex in which the acid is attached to one of the nitrogen atoms. The other nitrogen atoms will be attached to an inorganic or organic acid to form a neutralization product (a). One example of (A-10) is shown as $R_1$-$N^{\oplus}H_2C_3H_6NH_2.R_2COO^{\ominus}$.

The amine compound (A) which is a precursor of the neutralization product component (a) to be used as a base material of the softener for clothes according to the present invention includes the following compounds, alone or admixture with each other:

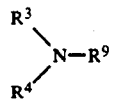
(A-1)

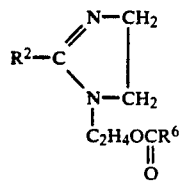
(A-2)

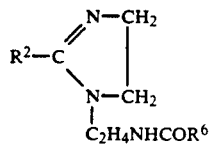
(A-3)

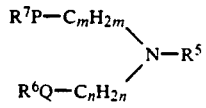
(A-4)

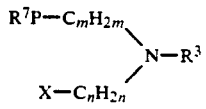
(A-5)

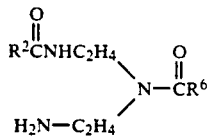
(A-6)

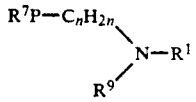
(A-7)

(A-8) amides each prepared by the condensation of $R^2COOH$ with a polyethylenepolyamine or polyethyleneimide having 4 to 5 nitrogen atoms or an N-(short-chain alkyl or alkenyl)polyalkylenepolyamine at a molar ratio of between 2:1 and 3:1, (A-9) amides each prepared by the condensation of $R^2COOH$ with an N-(long-chain alkyl or alkenyl)-polyalkylenepolyamine having 4 to 5 nitrogen atoms at a molar ratio of between 1:1 and 2:1 through dehydration, (A-10) ion pairs each constituted of $R^1NH(C_nH_{2n}NH)_lH$ and $R^2COOH$ at a molar ratio of 1:1 wherein $R^1$ is a hydrocarbon, alkanoyl or alkenoyl group having 12 to 22 carbon atoms, preferably a hydrocarbon group having 12 to 22 carbon atoms, $R^2$ and $R^6$ are each a hydrocarbon group having 11 to 21 carbon atoms, $R^3$ and $R^4$ are each a hydrocarbon group having 12 to 22 carbon atoms, $R^5$ is a hydrogen atom, a hydrocarbon or hydroxyalkyl group having 1 to 3 carbon atoms or $C_nH_{2n}R^7P$, preferably a hydrogen atom or a hydrocarbon or hydroxyalkyl group having 1 to 3 carbon atoms, $R^7P$, $R^8Q$ are each

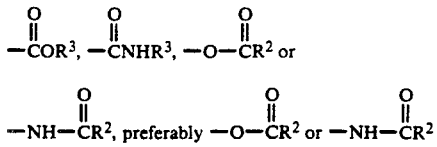

$R^9$ is a hydrogen atom or a hydrocarbon or hydroxyalkyl group having 1 to 3 carbon atoms, l is 1 to 2, m is 1 to 3, n is 2 to 3, and X is OH, $NH_2$ or $R^7P$ wherein $R^7P$ is defined as above.

Among these compounds, compounds having a

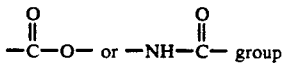

in its molecule are desirable. Particularly, compounds (A-2) to (A-7) are more desirable. among which the compounds (A-2), (A-3), (A-4) and (A-7) are most desirable.

The acid to be used in the neutralization of the amine compound (A) according to the present invention includes inorganic acids such as hydrochloric, acid sulfuric acid, nitric acid and phosphoric acids and organic acids each having at most 6 carbon atoms such as acetic, lactic, glycolic, citric and maleic acids, among which hydrochloric acid is most inexpensive and exhibits high performance. The neutralization step may be conducted by either dispersing a preliminarily prepared neutralization product in water or adding a liquid or solid amine compound (A) into an aqueous solution of an acid. Of course, an amine compound (A) and an acid component may be simultaneously added into water.

Production of (a) amine compound

As for (A-1), an aliphatic amine is converted to a corresponding nitrile compound, which is hydrogenated to obtain a di-long chain alkyl amine (A-12). (A-12) is converted by addition of ethylene oxide to (A-11) or by reaction with methyl chloride to (A-13).

(A-2), such as (A-21), is obtained by condensation and ring-closing reaction between hydroxyethylethylenediamine and a corresponding aliphatic acid or its ester such as methyl ester.

(A-3), such as (A-31), is obtained by condensation and ring-closing reaction between diethylenetriamine and a corresponding aliphatic acid or its ester such as methyl ester.

(A-4) is obtained by reacting an alkanolamine such as triethanolamine for (A-42 and A-47), tripropanolamine, N-methyldiethanolamine for (A-41) and N-methylpropanolamine with a fatty acid preferably having 12 to 24 carbon atoms or its methyl ester.

Alternatively (A-44) and (A-46) are obtained by cyanoethylation and hydrogenation of dialkanolamine such as N-lower alkylalkanolamine and diethanolamine to obtain a compound having the formula $R_1$-$N(C_3H_6NH_2)$ $(CmH_2mOH)$ in which $R_1$ is a lower alkyl or a hydroxyalkyl and m is 2 or 3, and then a reaction of the compound with an aliphatic acid.

(A-43) and (A-45) are obtained by a reaction between N-methyldipropylenetriamine or diethylenetriamine and an aliphatic acid.

(A-5) such as (A-51) is obtained by a reaction between an aliphaitc acid or its methyl ester and an alkanolamine such as N-long chain alkyldiethanolamine and N-long chain alkyl dipropanolamine.

(A-52) is obtained by cyanoethylation and hydrogenation of an N-long chain alkylamine to obtain a compound having the formula $R_1$-$N(C_3H_6NH_2)_2$ in which $R_1$ is a long alkyl, and then a reaction of the compound with an aliphatic aicd.

(A-7) such as (A-71) is obtained by cyanoethylation and hydrogenation of an N-long chain alkylamine to obtain a compound having the formula $R_1$-$NH(C_3H_6NH_2)$ in which $R_1$ is a long alkyl, and then a reaction of the compound with an aliphatic acid. (A-72) is obtained by addition of ethylene oxide to (A-71).

The compound having at least 3 active hydrogen atoms which is a starting compound for the preparation of the polyoxyalkylene adduct to be used in the present invention as the component (b) include polyhydric alcohols such as glycerol, pentaerythritol, sorbitol, sucrose, polyglycerol, polyvinyl alcohol and partially saponified polyvinyl acetate; polyhydric phenols such as phenolic resins and condensates of alkylphenol with formalin; and polyamines such as diethylenetriamine, triethylenetetramine, tetraethylenepentamine, pentaethylenehexamine and polyethyleneimine. Further, partial amides of these polyamines and N-alkyl-substituted derivatives thereof may also be used so long as they each have at least 3 active hydrogen atoms.

The polyether compound which is a polyoxyalkylene adduct can be easily prepared by adding an alkylene oxide component comprising ethylene oxide as an essential component to a compound having at least 3 active hydrogen atoms according to conventional processes. Particularly, adducts each constituted of ethylene oxide units alone and block or partial block adducts of ethylene oxide units and propylene oxide units are preferable. Although either of ethylene oxide and propylene oxide may be first added, a preferably concentrated softener for clothes is prepared by adding propylene oxide (hereinafter abbreviated to "PO") first and ethylene oxide (hereinafter abbreviated to "EO") next.

The polyether compound or the derivative thereof must have a molecular weight of 5,000 to 2,000,000, desirably 5,000 to 1,000,000, more desirably 5,000 to 200,000. Further, the sum total of EO chain segments must be at least 50% by weight, preferably at least 80% by weight, still preferably at least 85% by weight based on the whole molecular weight of the polyether compound.

The polyether compound to be used in the present invention is particularly preferably an adduct of a compound represented by the formula:

$$R^{10}NH(C_sH_{2s}NH)_rH$$

wherein $R^{10}$ is a hydrocarbon, alkanoyl or alkenoyl group each having 12 to 22 carbon atoms; s is 2 or 3; and r is 1 to 3 with alkylene oxide molecules where attached to form polyether.

Polyether derivatives according to the present invention includes those prepared by converting the terminal hydroxyl groups of the polyether compound into sulfate, phosphate, carboxyalkylate or fatty acid ester groups or cationizing part of the nitrogen atoms thereof. Fatty acid ester of the polyether compound and cationization products thereof are particularly preferable.

The fatty acid component constituting the fatty acid ester derivative is preferably one having 7 to 23 carbon atoms. The number of double bonds contained in the fatty acid and the branching thereof have little influence on the performance.

The cationized polyether derivative includes those prepared by a cationizing the polyether compound with dialkyl sulfate or alkyl halide and those prepared by neutralizing it with acetic acid or alkylbenzenesulfonic acid.

The contents of components (a) and (b) in the concentrated softener for clothes according to the present invention are suitably 7 to 30% by weight and 0.2 to 5% by weight, respectively, preferably 10 to 20% by weight and 0.5 to 3% by weight, respectively.

When the content of component (a) is less than 7% by weight, the resulting softener will have little advantage due to concentrate as compared with a conventional low-concentration one, while when the content thereof exceeds 30% by weight, the resulting softener will be so viscous so as to cause various troubles in handling.

When the content of component (b) is less than 0.2% by weight, the initial viscosity of the softener will be so high that the softener will not be effectively improved in handleability such as filming resistance in the open system, while the use of the component (b) in an amount exceeding 5% by weight will be uneconomical.

In the softener of the present invention, the repulsion between softener particles is lowered by the interaction of component (a) with component (b), when compared with a conventional dialkyl cation softener which is widely used, such that the distance between the particles is shortened, which is thought to be a reason why the softener of the present invention is improved in handleability; for example, the resistance to filming caused by the evaporation of water when stored in an open system.

The concentrated softener of the present invention may further contain a fatty acid having a saturated or unsaturated, straight-chain or branched hydrocarbon group having 11 to 21 carbon atoms in an amount of 0.1 to 5% by weight, preferably 0.1 to 2% by weight, as a component (C), to thereby further enhance the effects according to the present invention, particularly long-term storage.

The concentrated softener for clothes according to the present invention may further contain other additives which are conventionally used in a softener for clothes and such additives include perfume, dyestuff, nonionic surfactants such as polyoxyethylene (EO 5 to 50 molecular units) alkyl or alkenyl ether wherein the alkyl or alkenyl group has 12 to 24 carbon atoms, silicone compounds, antifungal agents, solvents such as ethanol, isopropyl alcohol, ethylene glycol and propylene glycol, and water-soluble salts such as common salt, sodium chloride, ammonium chloride and calcium chloride.

The concentrated softener of the present invention can be prevented from causing filming or lowering in handleability caused over time when stored in an uncapped bottle. Meanwhile, when a softener is applied to a washing machine fitted with an automatic feed throat for a softener which has recently been spread, various troubles such as deposit of a softener on the periphery of the throat or clogging of the throat with a softener results. These troubles can be effectively prevented by using the softener of the present invention.

EXAMPLE

The present invention will now be described in more detail by referring to the following Examples, though the present invention is not limited by them.

EXAMPLES 1 TO 36 AND COMPARATIVE EXAMPLES 1 TO 4

Softeners listed in Table 4 were each prepared by using a compound (a) listed in Table 1, a component (b) listed in Table 2 and, if necessary, a component (c) listed in Table 3, and evaluated by the following method:

1) Stability

The softeners listed in Table 4 were stored in a hermetically closed system at −10° C., room temperature and 50° C. for 20 days and examined for the changes in appearance and fluidity under closed conditions. Separately, 500 cc of each of the softeners was put in a cylinder having a diameter of 8 cm. The cylinders were stored in an open system at room temperature for 1 and 2 days and the resulting softeners were examined for appearance and fluidity. The results are given in Table 3.

All of the concentrated softeners according to the present invention exhibited little change even after the lapse of time, thus being excellent.

TABLE 1

| | Amine compound (A) | | |
|---|---|---|---|
| Symbol | General Formula | structure | Neutralizing agent |
| A-11 | A-1 | $R^3$, $R^4$: hardened tallow alkyl<br>$R^9$: hydroxyethyl | glycolic acid |
| A-12 | A-1 | $R^3$, $R^4$: oleyl<br>$R^9$: hydrogen | acetic acid |
| A-13 | A-1 | $R^3$, $R^4$: stearyl<br>$R^9$: methyl | hydrochloric acid |
| A-21 | A-2 | $R^2$, $R^6$: stearic acid residue | acetic acid |
| A-31 | A-3 | $R^2$, $R^6$: hardened tallow acid residue | hydrochloric acid |
| A-41 | A-4 | $R^5$: methyl<br>$R^7P$: $R^8Q$: $R-\overset{O}{\overset{\|\|}{C}}O-$ (R is a hardened tallow acid residue)<br>m = n = 2 | hydrochloric acid |
| A-42 | A-4 | $R^5$: hydroxyethyl<br>$R^7P$: $R^8Q$: $R-\overset{O}{\overset{\|\|}{C}}O-$ (R is a stearic acid residue)<br>m = n = 2 | acetic acid |
| A-43 | A-4 | $R^5$: methyl<br>$R^7P$: $R^8Q$: $R-\overset{O}{\overset{\|\|}{C}}NH-$ (R is a hardened tallow acid residue)<br>m = n = 3 | hydrochloric acid |
| A-44 | A-4 | $R^5$: methyl<br>$R^7P$: $C_{17}H_{35}-\overset{O}{\overset{\|\|}{C}}NH-$<br>$R^8Q$: $C_{17}H_{35}-\overset{O}{\overset{\|\|}{C}}O-$<br>m = 3, n = 2 | hydrochloric acid |
| A-45 | A-4 | $R^5$: hydrogen<br>$R^7P$: $R^8Q$: $C_{17}H_{35}-\overset{O}{\overset{\|\|}{C}}NH-$<br>m = n = 2 | hydrochloric acid |
| A-46 | A-4 | $R^5$: hydroxyethyl<br>$R^7P$: $C_{17}H_{35}-\overset{O}{\overset{\|\|}{C}}NH-$<br>$R^8Q$: $C_{17}H_{35}-\overset{O}{\overset{\|\|}{C}}O-$<br>m = 3, n = 2 | hydrochloric acid |

TABLE 1-continued

| Symbol | Amine compound (A) General Formula | structure | Neutralizing agent |
|---|---|---|---|
| A-47 | A-4 | $R^5$: $C_2H_4R^7P$<br>$R^7P$: } $C_{17}H_{35}-\overset{O}{\overset{\|\|}{C}}O-$<br>$R^8Q$: }<br>m = n = 2 | hydrochloric acid |
| A-51 | A-5 | $R^3$: hardened tallow alkyl<br>$R^7P$: $C_{17}H_{35}-\overset{O}{\overset{\|\|}{C}}O-$<br>X: OH<br>m = n = 2 | hydrochloric acid |
| A-52 | A-5 | $R^3$: oleyl<br>$R^7P$: $C_{17}H_{35}-\overset{O}{\overset{\|\|}{C}}NH-$<br>X: $R^7H$<br>m = n = 3 | hydrochloric acid |
| A-71 | A-7 | $R^1$: lauryl<br>$R^7P$: $C_{17}H_{35}-\overset{O}{\overset{\|\|}{C}}NH-$<br>$R^9$: hydrogen<br>n = 3 | hydrochloric acid |
| A-72 | A-7 | $R^1$: hardened tallow alkyl<br>$R^7P$: $C_{17}H_{35}-\overset{O}{\overset{\|\|}{C}}NH-$<br>n = 3<br>$R^9$: hydroxyethyl | hydrochloric acid |
| A-81 | A-8 | condensate of two stearic acid molecules with one tetraethylene pentamine molecule | hydrochloric acid |
| A-91 | A-9 | condensate of stearic acid with N-hardened tallow alkyl tripropylenetetramine at a molar ratio of 1:1 | hydrochloric acid |
| A-101 | A-10 | $R^1$, $R^2$: hardened tallow alkyl<br>n = 3<br>l = 1 | hydrochloric acid |

TABLE 2

| Symbol | Starting material | Component (b) (number of active hydrogen atoms) | Alkylene[1] oxide | (ratio)[2] | MW | modification |
|---|---|---|---|---|---|---|
| B-1 | glycerin | (3) | PO/EO | (1/9) | 9,500 | — |
| B-2 | ethylenediamine | (4) | PO/EO) | (3/7) | 16,000 | — |
| B-3 | diethanolamine | (3) | PO/EO | (1/9) | 8,800 | — |
| B-4 | sorbitol | (6) | PO/EO | (2/8) | 12,800 | — |
| B-5 | sorbitol | (6) | EO | | 14,000 | — |
| B-6 | phenolic resin (decanuclear) | (10) | EO | | 20,000 | — |
| B-7 | triethylenetetramine | (6) | PO/EO | (2/8) | 13,000 | — |
| B-8 | triethylenetetramine | (6) | PO/EO | (2/8) | 13,000 | modified with oleic acid (1/6)[3] |
| B-9 | triethylenetetramine | (6) | PO/EO | (2/8) | 13,000 | diethyl sulfate (3/6)[4] |
| B-10 | tetraethylenepentamine | (7) | PO/EO | (2/8) | 16,000 | — |
| B-11 | tetraethylenepentamine | (7) | EO | | 15,000 | — |
| B-13 | polyethyleneimine (MW: 1600) | (38) | PO/EO | (2/8) | 70,000 | — |
| B-13 | polyethyleneimine (MW: 1600) | (38) | EO | | 100,000 | — |
| B-14 | oleamide of tetraethylenepentamine | (6) | EO | | 8,000 | — |
| B-15 | N-hardened tallow alkyl dipropylenetriamine | (4) | PO/EO | (1/9) | 29,000 | — |
| B-16 | N-oleylpropylenediamine | (3) | EO | | 12,000 | — |

TABLE 2-continued

| Symbol | Starting material | Component (b) (number of active hydrogen atoms) | Alkylene[1] oxide | (ratio)[2] | MW | modification |
|---|---|---|---|---|---|---|
| B-17 | N-stearoyldipropylenetriamine | (4) | EO | | 20,000 | — |

In Table 2.
[1]PO: propylene oxide,
EO: ethylene oxide
[2]weight ratio
[3]degree of esterification with respect to terminal hydroxyl group
[4]degree of cationization per nitrogen atom

TABLE 3

| Symbol | Other component Component |
|---|---|
| C-1 | stearic acid |
| D-2 | di (hardened tallow alkyl) dimethylammonium chloride |

TABLE 3-continued

| Symbol | Other component Component |
|---|---|
| D-3 | polyoxyethylene oleyl alcohol (number of ethylene oxide units added: 20) |

TABLE 4

Stability of concentrated softener for clothes

| No. | Composition of concentrated softener for clothes: component (a) comp. | component (a) amt.* | component (b) comp. | component (b) amt.* | salt comp. | salt amt.* | other component comp. | other component amt.* | Initial properties: viscosity (cps) | Initial properties: appearance |
|---|---|---|---|---|---|---|---|---|---|---|
| Comp. Ex. | | | | | | | | | | |
| 1 | — | — | — | NaCl | 0.2 | D-2 | 15 | >800 | gel | |
| 2 | A-11 | 15 | — | — | $CaCl_2$ | 0.2 | — | — | >800 | gel |
| 3 | A-51 | 15 | — | — | $CaCl_2$ | 0.2 | D-3 | 2 | 480 | good |
| 4 | — | — | B-9 | 2 | $CaCl_2$ | 0.2 | D-2 | 15 | 180 | good |
| Ex. | | | | | | | | | | |
| 1 | A-11 | 15 | B-1 | 2 | NaCl | 0.2 | — | — | 140 | good |
| 2 | A-12 | 15 | B-9 | 2 | $CaCl_2$ | 0.2 | — | — | 120 | good |
| 3 | A-13 | 15 | B-9 | 1 | $CaCl_2$ | 0.2 | — | — | 120 | good |
| 4 | A-13 | 18 | B-17 | 1 | — | — | — | — | 100 | good |
| 5 | A-21 | 15 | B-2 | 2 | NaCl | 0.2 | C-1 | 0.5 | 80 | good |
| 6 | A-31 | 15 | B-3 | 2 | — | — | — | — | 120 | good |
| 7 | A-31 | 18 | B-7 | 1 | $CaCl_2$ | 0.2 | — | — | 110 | good |
| 8 | A-41 | 18 | B-15 | 2 | — | — | — | — | 100 | good |
| 9 | A-41 | 15 | B-4 | 2 | NaCl | 0.2 | — | — | 140 | good |
| 10 | A-41 | 15 | B-5 | 2 | $CaCl_2$ | 0.2 | — | — | 120 | good |
| 11 | A-41 | 15 | B-6 | 2 | $CaCl_2$ | — | — | — | 100 | good |
| 12 | A-41 | 18 | B-7 | 1 | — | — | — | — | 110 | good |
| 13 | A-41 | 18 | B-8 | 2 | — | — | — | — | 110 | good |
| 14 | A-41 | 18 | B-16 | 1 | — | — | — | — | 120 | good |
| 15 | A-42 | 18 | B-8 | 1 | $CaCl_2$ | 0.1 | — | — | 120 | good |
| 16 | A-42 | 18 | B-9 | 1 | — | — | C-1 | 0.5 | 70 | good |
| 17 | A-43 | 15 | B-4 | 2 | $CaCl_2$ | 0.2 | — | — | 110 | good |
| 18 | A-43 | 18 | B-10 | 2 | $CaCl_2$ | 0.2 | — | — | 130 | good |
| 19 | A-44 | 18 | B-11 | 1 | — | — | — | — | 90 | good |
| 20 | A-44 | 18 | B-12 | 2 | — | — | C-1 | 0.5 | 70 | good |
| 21 | A-44 | 18 | B-17 | 1 | — | — | — | — | 120 | good |
| 22 | A-45 | 18 | B-13 | 1 | $CaCl_2$ | 0.1 | — | — | 130 | good |
| 23 | A-46 | 18 | b-14 | 1 | — | — | — | — | 100 | good |
| 24 | A-47 | 15 | B-4 | 2 | $CaCl_2$ | 0.2 | — | — | 100 | good |
| 25 | A-51 | 15 | B-3 | 1 | — | — | — | — | 100 | good |
| 26 | A-51 | 18 | B-8 | 2 | — | — | — | — | 110 | good |
| 27 | A-51 | 18 | B-16 | 1 | — | — | — | — | 120 | good |
| 28 | A-71 | 15 | B-4 | 1 | $CaCl_2$ | 0.1 | — | — | 120 | good |
| 29 | A-71 | 18 | B-9 | 1 | — | — | — | — | 100 | good |
| 30 | A-72 | 18 | B-15 | 2 | $CaCl_2$ | 0.2 | — | — | 110 | good |
| 31 | A-81 | 18 | B-10 | 2 | $CaCl_2$ | 0.2 | — | — | 130 | good |
| 32 | A-81 | 18 | B-11 | 1 | — | — | — | — | 100 | good |
| 33 | A-91 | 18 | B-12 | 2 | — | — | — | — | 140 | good |
| 34 | A-101 | 18 | B-17 | 1 | $CaCl_2$ | 0.1 | — | — | 120 | good |
| 35 | A-101 | 18 | B-13 | 1 | — | — | — | — | 130 | good |
| 36 | A-101 | 18 | B-14 | 1 | — | — | — | — | 100 | good |

| Comp. No. | long-term stability: after 20 days in a closed system, −10°C. | room temp. | 50° C. | stability in open system**, room temp., 1 day | 3 days | 50° C., 1 day | 2 days |
|---|---|---|---|---|---|---|---|

TABLE 4-continued

| Stability of concentrated softener for clothes | | | | | | | |
|---|---|---|---|---|---|---|---|
| 1 | — | — | — | — | — | — | — |
| 2 | — | — | — | — | — | — | — |
| 3 | good | gel | gel | Δ | Δ | x | x |
| 4 | viscosity | good | good | Δ | Δ | x | x |
| Ex. | | | | | | | |
| 1 | good | good | good | ○ | Δ | ○ | Δ |
| 2 | good | good | good | ○ | Δ | ○ | Δ |
| 3 | good | good | good | ○ | Δ | ○ | Δ |
| 4 | good | good | good | ○ | ○ | ○ | ○ |
| 5 | good | good | good | ○ | ○ | ○ | ○ |
| 6 | good | good | good | ○ | ○ | ○ | ○ |
| 7 | good | good | good | ○ | ○ | ○ | ○ |
| 8 | good | good | good | ○ | ○ | ○ | ○ |
| 9 | good | good | good | ○ | ○ | ○ | ○ |
| 10 | good | good | good | ○ | ○ | ○ | ○ |
| 11 | good | good | good | ○ | ○ | ○ | ○ |
| 12 | good | good | good | ○ | ○ | ○ | ○ |
| 13 | good | good | good | ○ | ○ | ○ | ○ |
| 14 | good | good | good | ○ | ○ | ○ | ○ |
| 15 | good | good | good | ○ | ○ | ○ | ○ |
| 16 | good | good | good | ○ | ○ | ○ | ○ |
| 17 | good | good | good | ○ | ○ | ○ | ○ |
| 18 | good | good | good | ○ | ○ | ○ | ○ |
| 19 | good | good | good | ○ | ○ | ○ | ○ |
| 20 | good | good | good | ○ | ○ | ○ | ○ |
| 21 | good | good | good | ○ | ○ | ○ | ○ |
| 22 | good | good | good | ○ | ○ | ○ | ○ |
| 23 | good | good | good | ○ | ○ | ○ | ○ |
| 24 | good | good | good | ○ | ○ | ○ | ○ |
| 25 | good | good | good | ○ | ○ | ○ | ○ |
| 26 | good | good | good | ○ | ○ | ○ | ○ |
| 27 | good | good | good | ○ | ○ | ○ | ○ |
| 28 | good | good | good | ○ | ○ | ○ | ○ |
| 29 | good | good | good | ○ | ○ | ○ | ○ |
| 30 | good | good | good | ○ | ○ | ○ | ○ |
| 31 | good | good | good | ○ | ○ | ○ | ○ |
| 32 | good | good | good | ○ | ○ | ○ | ○ |
| 33 | good | good | good | ○ | ○ | ○ | ○ |
| 34 | good | good | good | ○ | ○ | ○ | ○ |
| 35 | good | good | good | ○ | ○ | ○ | ○ |
| 36 | good | good | good | ○ | ○ | ○ | ○ |

*% by weight
**○: good without filming
Δ: fluid with filming
x: not fluid

EXAMPLES 37 TO 39

The component (C-1) was added to the composition of Example 15 to prepare softeners. The softeners were examined for long-term storage stability at room temperature in an open system and the results are given in Table 5.

TABLE 5

| Long-term storage stability at room temperature in open system | | | |
|---|---|---|---|
| | Amt. of component (C-1) (% by weight) | Storage stability*1 5 days | 7 days |
| Example 15 | 0 | Δ | Δ |
| Example 37 | 0.1 | ○ | Δ |
| Example 38 | 0.2 | ○ | ○ |
| Example 39 | 0.5 | ○ | ○ |

Note)
*1○: good without filming
Δ: fluid with filming

We claim:

1. A concentrated softener comprising (a) 7 to 30% by weight of a neutralization product of one or a mixture of the following amine compounds with an inorganic acid or an organic acid having not more than 6 carbon atoms:

(a-1) amines each having 2 to 3 hydrocarbon groups wherein each of said hydrocarbon groups has 11 to 22 carbon atoms; and (a-2) ion pairs each between (i) a polyamine having 2 to 5 nitrogen atoms and one hydrocarbon group having 11 to 22 carbon atoms; and (ii) a fatty acid having 12 to 22 carbon atoms at a molar ratio of 1:1 respectively; and;

(b) 0.2 to 5% by weight of one or more polyether compounds which are each an adduct of a compound having at least 3 active hydrogen atoms, with an alkylene oxide component comprising ethylene oxide as an essential component, wherein the sum total of the polyoxyethylene chain segments is at least 50% of the total weight and wherein the molecular weight is 5,000 to 2,000,000 of said polyether compound, and derivatives thereof.

2. The concentrated softener as set forth in claim 1, wherein said amine compound has two hydrocarbon groups each having 11 to 22 carbon atoms and a $$-\overset{\overset{\displaystyle O}{\|}}{C}-O- \text{ group and/or a } -\overset{\overset{\displaystyle O}{\|}}{C}NH- \text{ group}$$

in its molecule.

3. The concentrated softener as set forth in claim 1, wherein said amine compound (a−2) is prepared from $$R^1NH(C_nH_{2n}NH)_l H \text{ and } R^2\overset{O}{\overset{\|}{C}}OH$$

wherein $R^1$ is a hydrocarbon, alkanoyl or alkenoyl group having 12 to 22 carbon atoms; $R^2$ is a hydrocarbon group having 11 to 21 carbon atoms; n is 2 or 3; and l is 1 to 2 at a molar ratio of, respectively 1:1.

4. The concentrated softener as set forth in any of claims 1 to 3, wherein said polyether compound is an adduct of a compound represented by the formula:

$$R^{10}NH(C_sH_{2s}NH)_rH$$

wherein $R^{10}$ is a hydrocarbon, alkanoyl or alkenoyl group having 12 to 22 carbon atoms; s is 2 or 3; and r is 1 to 3 with said alkylene oxide.

5. A concentrated softener as set forth in any of claims 1, 2 and 4, which further comprises 0.1 to 5% by weight of a fatty acid having a hydrocarbon group having 11 to 21 carbon atoms.

6. The concentrated softener according to claim 1, wherein said component (a) is present in an amount of 10 to 20% by weight; and said component (b) is present in an amount of 0.5 to 3% by weight.

7. The concentrated softener according to claim 1, wherein said component (b) contains only ethylene oxide units for said alkylene oxide component.

8. The concentrated softener according to claim 1, wherein said component (b) contains block or partial block adducts of ethylene oxide and propylene oxide.

* * * * *